US005082458A

United States Patent [19]

Poerschke

[11] Patent Number: 5,082,458

[45] Date of Patent: Jan. 21, 1992

[54] FUSE HOLDER

[75] Inventor: Karl D. Poerschke, Sprockhovel, Fed. Rep. of Germany

[73] Assignee: Wickmann-Werke GmbH, Witten, Fed. Rep. of Germany

[21] Appl. No.: 408,428

[22] Filed: Sep. 15, 1989

Related U.S. Application Data

[63] Continuation of Ser. No. 149,900, Jan. 28, 1988, abandoned, which is a continuation of Ser. No. 896,187, Aug. 14, 1986, abandoned.

[30] Foreign Application Priority Data

Aug. 17, 1985 [DE] Fed. Rep. of Germany ..... 8523729

[51] Int. Cl.[5] ..... H01R 33/95; H01H 85/02

[52] U.S. Cl. ..... 439/621; 337/201

[58] Field of Search ..... 337/195, 198, 201, 213; 439/621, 622

[56] References Cited

U.S. PATENT DOCUMENTS

| | | | |
|---|---|---|---|
| 1,349,485 | 8/1920 | Yokel | 439/316 |
| 2,386,060 | 10/1945 | Powell | 337/213 |
| 2,742,545 | 4/1956 | Sundt | 337/201 |
| 3,980,387 | 9/1976 | Neidecker | 339/256 R |
| 4,329,006 | 5/1982 | Gale | 337/213 |
| 4,411,486 | 10/1983 | Behrendt | 339/147 R |
| 4,481,496 | 11/1984 | Norden | 337/213 |
| 4,504,815 | 3/1985 | Harwath | 337/201 |
| 4,536,054 | 8/1985 | Wallner et al. | 339/147 R |
| 4,930,225 | 6/1983 | Coyne et al. | 439/622 |

FOREIGN PATENT DOCUMENTS

| | | | |
|---|---|---|---|
| 370777 | 10/1921 | Fed. Rep. of Germany | 337/213 |
| 3246643 | 9/1983 | Fed. Rep. of Germany . | |

*Primary Examiner*—Gary F. Paumen

*Attorney, Agent, or Firm*—Banner, Birch, McKie & Beckett

[57] ABSTRACT

The invention relates to a fuse holder, which essentially comprises a casing and a carrier which can be engaged therein with the aid of a bayonet-lock between which is resiliently received e.g. a fuse link. While a conventional foot contact on the bottom of the casing ensures an electric supply, a contact bridge metal strip in the carrier provides an electrical connection with the other cap of the fuse link to a side contact in the casing. The contacting takes place only when the carrier is turned fully home in the one pin bayonet-lock which thus allows only one locked position between the carrier and the casing.

11 Claims, 3 Drawing Sheets

FUSE HOLDER

This application is a continuation of patent application Ser. No. 149,900 filed Jan. 28, 1988 and now abandoned, which is a continuation of patent application Ser. No. 896,187 filed Aug. 14, 1986 and now abandoned.

BACKGROUND OF THE INVENTION

1. Field of the Invention

The invention relates to a fuse holder for holding a fuse link comprising a substantially tubular casing and a tubular carrier for receiving the fuse link, the carrier and the casing being made of an electrically isolating plastic material. More particularly the invention relates to a fuse holder comprising a foot contact on the inside of the closed bottom side of the casing for electrically contacting the first of the two metal caps of the fuse link, the foot contact is extended out of the casing to form a first contact lug, a side contact within,. the tubular casing extends out of the casing to form a second contact lug, a bayonet-type lock between the carrier and the casing, a contact bridge within the carrier for electrically connecting the second of the two metal caps of the fuse link to the side contact when the carrier together with the fuse link is locked into the casing by the bayonet-type lock, and a spring received between the inside of the closed front side of the carrier and the second metal cap for urging the first metal cap against the foot contact in the locked position of the carrier.

2. Prior Art

In case of the known fuse holders of the aforementioned type, the contact bridge is normally made from a one or multiple part sleeve, which forms both the mechanical mounting for the fuse link and simultaneously connects the second metal cap to the side contact of the holder. In such cases the contact bridge also serves as the mechanical mounting means for the carrier within the casing. In more recent constructions, due to worldwide regulations, provision has to be made that during the replacement of a blown fuse link, no current carrying part can make contact directly or indirectly with the human body. It is obvious to fulfill this requirement, by constructing the carrier to be inserted into the casing so that it extends as far as possible over the fuse link so as to prevent any contact with human fingers. Simultaneously, fixing the carrier within the casing is done by a thread or a bayonet-type joint directly formed into the plastic material as for instance shown in the German Offenlegungsschrift 32 46 643. Similar solutions are used in commercially available holders.

OBJECTS OF THE INVENTION

The contact bridge located within the carrier has to fulfill the following functions:

1. Low-resistance contacting to the fuse link is sought.

2. Low-resistance contacting to the side contact is desired.

3. The construction should be manufactured easily and cost-effectively. The construction should be reliable and safe as to the impossibility to contact parts carrying current with the human body and the construction has to be easy to operate to replace a blown fuse link.

The known constructions only fulfill these requirements to a limited extent.

The invention proposes to improve a known type of fuse holder by a contact bridge having the shape of a metal strip terminating in a contact tongue, by a side contact having the shape of a metal strip, by anchoring means for retaining the contact bridge metal strip against rotational movement within the carrier and by positioning means for allowing only one rotational position of the carrier within the casing in the locked position. The contact bridge metal strip and the side contact metal strip are so arranged within the carrier, that the casing in the locked position with the carrier places the metal strips in contact with each other. The contact bridge metal strip is either clamped or pressed into the tubular carrier or the carrier has a longitudinal slot into which the contact bridge metal strip is buried. The means for positioning the rotational position of the carrier against the casing is most preferably a one pin bayonet-lock which leaves only one possibility to the user for locking the carrier to the casing.

This construction of the fuse holder makes it possible to fulfill all the above requirments. Contacting of the second metal cap to the contact bridge and by the contact tongue to the side contact takes place in a low-resistance manner. When provided with a bow-like section the contact bridge metal strip engages with the side-wall of the second cap of the fuse link and presses the same against the opposite wall of the insulating material of the carrier, so that the fuse link is mounted within the carrier by friction contact.

As will be shown hereinafter, the anchoring means can be constructed in many different ways, so that a very easily manufacturable metal part is obtained for the contact bridge which still fulfills the aforementioned requirements.

Preferably, the anchoring means comprises a section of the contact bridge metal strip bent to form a slotted annular ring, the ring being resiliently clamped into the tubular carrier. A further alternative proposes that a section of the contact bridge metal strip is bent rectangularly away from the remaining metal strip, the bent-away-section having the shape of a circle, a square, a trapezoid or a triangle, each shape being clamped into the tubular carrier. The bent-away-sections may have at least one point, a clamp or a tooth for penetration into the carrier material. All embodiments lead to a reliable anchoring of the contact bridge to the carrier made from insulating material.

In order to improve the mechanical pre-fixing of a fuse link within the carrier, the bow-like section of the contact bridge metal strip has a step for a snap-fit with the lower rim of the second metal cap of the fuse link. The step is easily overcome during the loading of a fuse link into the carrier and then engages behind the rim of the metal cap.

BRIEF DESCRIPTION OF THE DRAWINGS

Embodiments of the invention are described in greater detail hereinafter relative to the drawings in which.

DETAILED DESCRIPTION OF THE EMBODIMENTS

Figure 1:
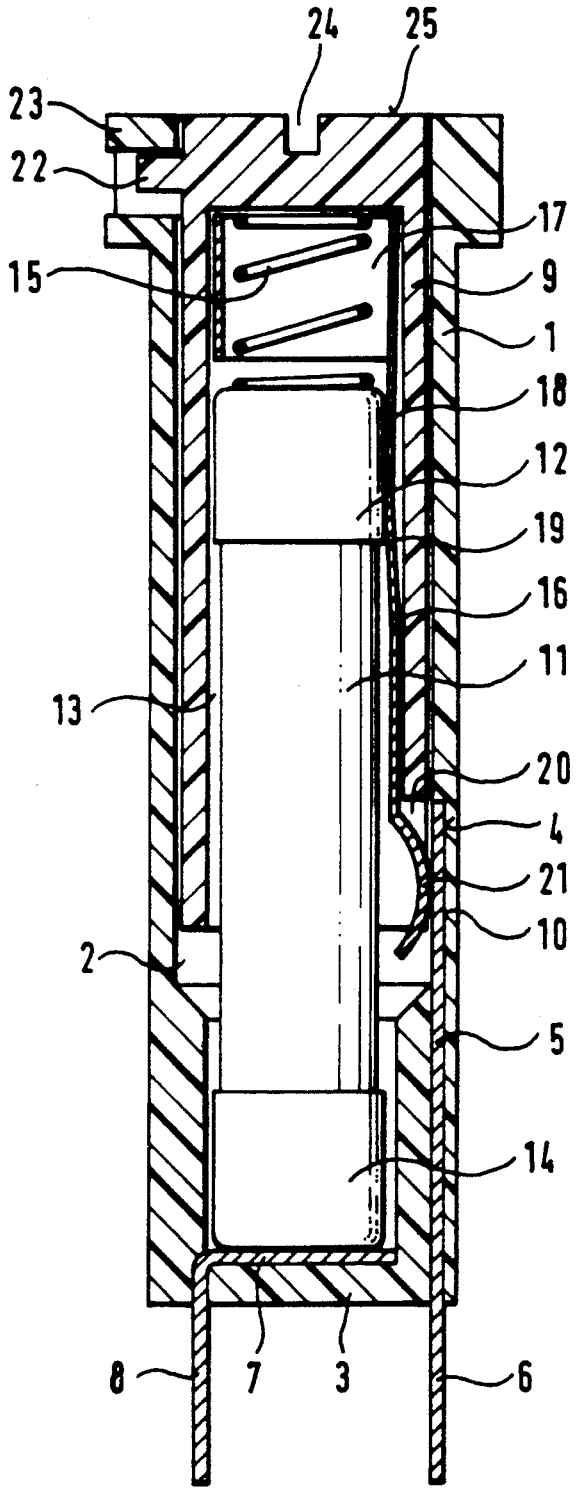
FIG. 1 shows a sectional view of a fuse holder according to the invention holding a fuse link.

The fuse holder shown in FIG. 1 has a tubular, insulating material casing 1 which has an open front side and which also has a tubular, stepped bore 2, the lower part of which is closed by a bottom 3. A strip-like side contact 5 is fixed in a recess 4, which can be contacted from the bore 2 in the upper part and which is otherwise passed through the lower part of the wall of casing 1 and the portion projecting from bottom 3 serves as a second contact lug 6. On the inside of the bottom 3 there is provided a foot contact 7, which in bent form extends through bottom 3 and then continues on into a first contact lug 8. A tubular, isolating material carrier 9 is open at the bottom side and closed at the front side. The carrier 9 is inserted into the bore 2 of casing 1 together with a fuse link 11, whose second metal cap 12 is held at 13 within the carrier 9, whilst its first cap 14 electrically conductively engages on foot contact 7 under the action of a spring 15 arranged at the inner end of carrier 9.

A contact bridge metal strip 16 extends in the longitudinal direction of carrier 9 against the inner wall thereof and is reliably and securely anchored to the inner end of the carrier 9 by means of anchoring means 17. The anchoring means 17 is e.g. constructed in the manner shown in FIGS. 2*a* or 4*a* or 4*b*, so that if the contact bridge metal strip 16 is pressed into carrier 9 the anchoring means 17 obtains a positive, reliable seating in the carrier 9 by means of the sharp edges or claw-like securing elements.

The contact bridge metal strip 16 has a bow-like section 18 formed in the vicinity of the second metal cap of the fuse link 11, in order to obtain the shown lateral contacting on inserting the same into the carrier 9. Thus, in the relaxed state the bow-like section 18 projects sideways and inwards.

At the point designated 19, there can be a step within the contact bridge metal strip 16 which engages behind the rim of the second metal cap 12 so that the fuse link 11 is not only secured by the lateral pressure of the bow-like section 18 in frictionally gripping manner in the carrier 9, but is also positively secured.

From the step 19, the contact bridge metal strip 16 passes in engagement with the wall of the carrier 9 up to a slot 20 on the lower edge in the wall of the carrier 9, where, in the represented form, the contact bridge metal strip 16 is curved to form a resilient contact tongue 21, which is in contact with the free upper part 10 of side contact 5 by passing through the slot 20 in carrier 9.

In the shown angular position of the carrier with respect to the casing 1 the carrier 9 is locked in the axial direction through a bayonet-lock in the upper part of the casing 1 and the carrier 9. A projection 22 or pin engages under an edge portion 23 which is a part of the casing 1. A slot 24 is provided in conventional manner on the exposed end face 25 of the carrier 9 for rotating the same with respect to the casing 1, for instance with the aid of a screw driver, a coin or the like, so as to lock or unlock by turning the carrier 9 with respect to the casing 1 on inserting or replacing the fuse link 11.

There is only one pin or projection 22 so that there is one definite position of the carrier 9 relative to the casing 1. In this way in the locked position the contact tongue 21 is in contact with the side contact 5 thus rendering the contact bridge metal strip 16 currentless until the carrier has been turned fully home.

FIGS. 2 to 9 show differently shaped blanks 16*a*, punched or stamped from spring sheet metal for producing differently shaped contact bridge metal strips 16. For example for obtaining the contact bridge metal strip 16 shown in FIG. 2*a* with a slotted ring 17 as an anchoring means a T-shaped blank 16*a* is used and bent. The slotted ring 17 has an oversized diameter compared to the inner diameter of the carrier 9 at 13 and the annular wall may be formed in a frusto-conical shape in order to inhance the anchoring forces. Further up from the annular slotted ring 17 there is the bow-like section 18, the step 19 and the contact tongue 21.

Figure 3:
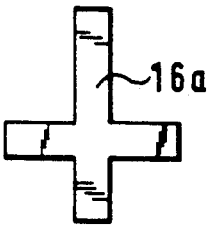
Figure 3A:
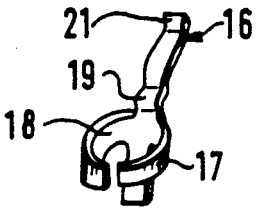
Figure 3B:
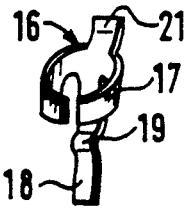

Depending on the position of the anchoring means along the internal space 13 of the carrier 9 contact bridge metal strips 16 according to FIGS. 3*a* or 3*b* are chosen which are obtained from near cross-shaped blanks 16*a* according to FIG. 3.

Figure 4:
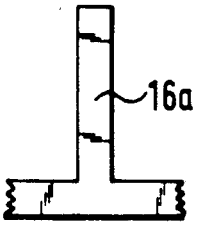
Figure 4A:
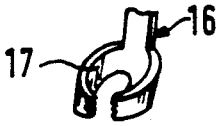
Figure 4B:
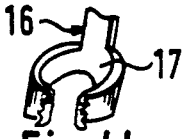

From a T-shaped blank 16*a* according to FIG. 4 having teeth at the outer ends of the cross member a contact bridge metal strip 16 according to FIGS. 4*a* and 4*b* is obtained in which the anchoring means 17 have slightly protruding or heavily protruding claws for a penetration into the isolating material of the carrier 9. The not shown part of the contact bridge metal strips 16 in FIGS. 4*a* and 4*b* are for instance shaped in the manner shown in FIG. 1.

Figure 5:
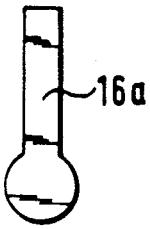
Figure 5A:
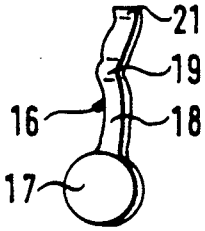

From the blank 16*a* according to FIG. 5 there is obtained a contact bridge metal strip 16 according to FIG. 5*a* having a circular anchoring means 17 which is pressed into the carrier 9 until it engages on the closed front side and is reliably seated there due to its larger cross-section.

Figure 6:
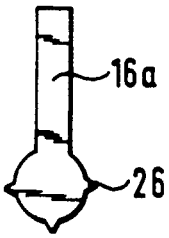
Figure 6A:
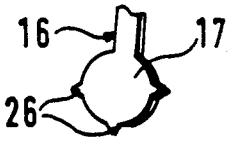

A very similar shape to that of FIGS. 5 and 5*a* for a contact bridge metal strip 16 according to FIG. 6*a* is obtained from the blank 16*a* according to FIG. 6. There are three points 26 on the edge of the anchoring means 17 which penetrate into the material of the carrier 9 during fitting.

Figure 7:
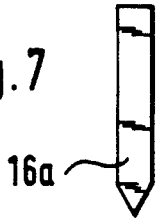
Figure 8:
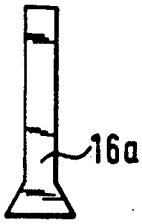
Figure 7A:
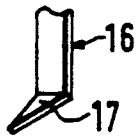
Figure 8A:
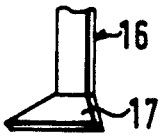

A particularly simple and material-saving shape for blank 16*a* and contact bridge metal strip 16 is achieved the embodiments of FIGS. 7 and 8 which are formed into respectively 7*a* and 8*a*. The anchoring means 17 are firmly engaged in the wall of the carrier 9 due to the tapering edges of the triangular or trapezoidal fixing parts 17 whilst the remainder of the design is that of FIG. 2*a*.

Figure 2:
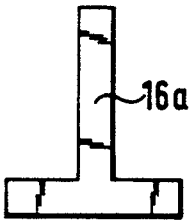
FIGS. 2 to 9 show the front side of metal strip blanks of different shapes for making differently shaped contact bridge metal strips.
Figure 2A:
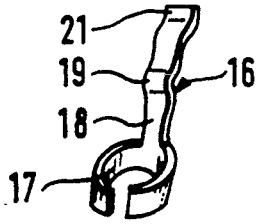
FIGS. 2*a*, 3*a* and *b*, 4*a* and *b*, 5*a*, 6*a*, 7*a*, 8*a* and 9*a* show perspective views of differently formed contact bridge metal strips from the blanks according to FIGS. 2 to 9.
Figure 9:
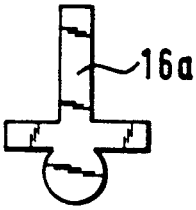
Figure 9A:
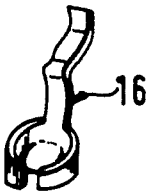

FIGS. 9 and 9*a* show a mixed form by combining the design of the anchoring means 17 from FIGS. 2*a* and 5*a* for further reinforcing the anchoring of the contact bridge metal strip 16 within the carrier 9.

Figure 10:
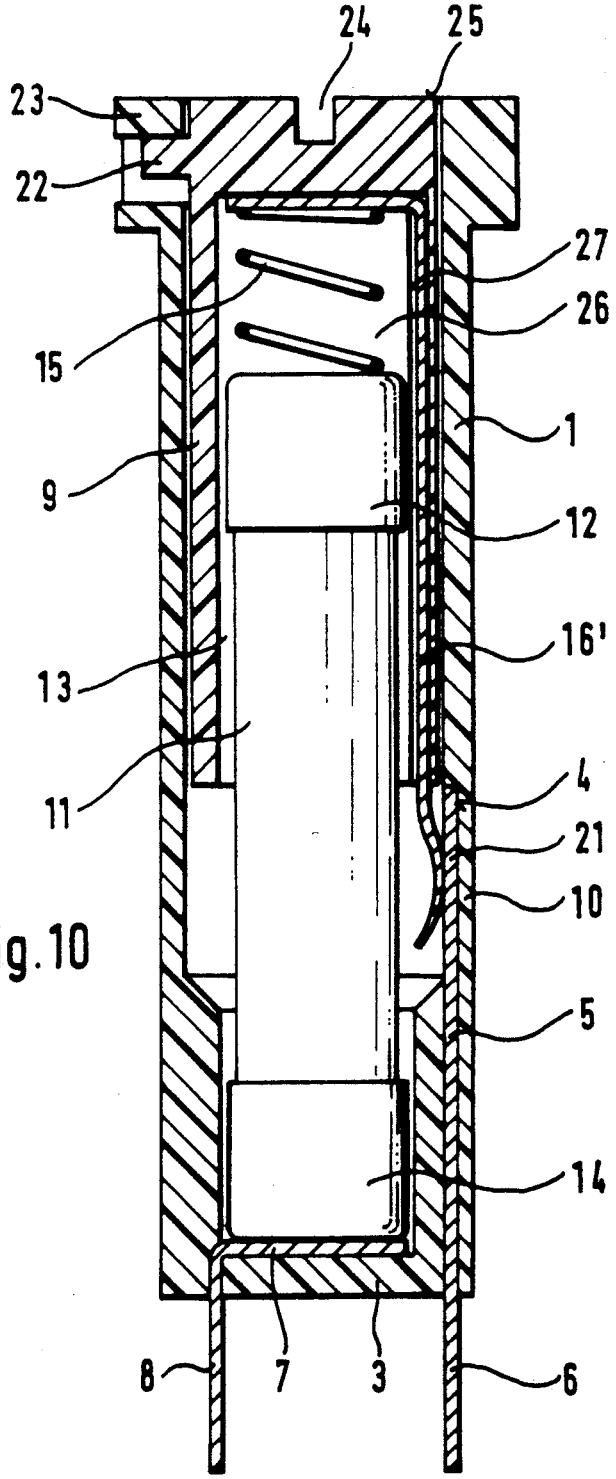
FIG. 10 shows a sectional view according to FIG. 1 of a further embodiment of the fuse holder according to the invention.

The embodiment shown in FIG. 10 differs from that of FIG. 1 essentially through the construction of the open end of the carrier 9 and by the design of the contact bridge metal strip 16'. The open end of the carrier 9 has the shape of a cut-off tube and is shorter than in the embodiment according to FIG. 1. At one point of the inner wall of the carrier 9 which is cut in FIG. 10, a longitudinal slot 27 is located over the entire length of the inner cavity 26 of the carrier 9 and into this slot 27 the contact bridge metal strip 16 is fitted. As before a contact tongue 21 shaped into the contact bridge metal strip 16' projects over the carrier 9 and engages on the inside of the side contact 5 if the one-pin bayonet-lock is turned fully home.

The lower section of the contact bridge metal strip 16' is bent over at a right angle on the end remote from the contact tongue 21 and the bent-over-part forms the rest of the spring 15 which at least maintains reliable contact with the contact bridge metal strip 16' to the second metal cap 12 of the fuse link 11. The contact bridge metal strip 16' is shown absolutely straight within the slot 27. But of course, a bow-like section as described together with the embodiment according to FIG. 1 can be incorporated into this contact bridge metal strip 16' in order to guaranty contact of this member against the side-wall of the second or upper metal cap 12 of the fuse link 11. The longitudinal slot 27 firmly secures the contact bridge metal strip 16' within the cavity 26 of the carrier 9 so that there can be no displacement in the rotational direction of the carrier 9 on engaging the bayonet-lock. The second metal cap 12 of the fuse link 11 prevents any movement of the contact bridge metal strip 16' out of the longitudinal slot 27. This ensures that in the locked position of the carrier 9 there is always contact between the contact tongue 21 and the side contact 5.

The slot 27 is just as wide as the contact bridge metal strip 16' so that there is perfect embedding. Differently from the shown embodiment the slot 27 can be less deep, for instance half as deep as the contact bridge metal strip 16' is thick, so that there is a permanent contact from the outset between the metal cap of the fuse link 11 due to the chosen tolerances of the cavity 26.

All components provided with reference numerals in FIG. 10 and which are not separately described are used in the same way and serve the same purpose as the corresponding components in the embodiment according to FIG. 1.

What is claimed is:

1. Fuse holder for holding a fuse link comprising a substantially tubular casing having a closed bottom and an open top, a substantially tubular carrier for receiving the fuse link having a closed top and an open bottom, a foot contact extending across the closed bottom of the casing for electrically contacting the first of the two metal caps of the fuse link, the foot contact being extended downwardly out of the casing bottom for forming a first contact lug, a side contact within the tubular casing extending downwardly out of the casing bottom for forming a second contact lug, a bayonet-type lock provided between said carrier and said casing, a contact bridge within the carrier for electrically connecting the second of the two metal caps of the fuse link to said side contact when the carrier together with the fuse link is locked into the casing by said bayonet-type lock, a spring received between the inside of the closed top of said carrier and the second metal cap of the fuse link for urging the first metal cap against said foot contact in the locked position of said carrier and said casing, said contact bridge having the shape of an elongated metal strip terminating in a contact tongue, said side contact having the shape of an elongated metal strip, anchoring means for retaining said contact bridge metal strip against rotational movement within said carrier, positioning means for allowing only one rotational position of said carrier within said casing in the locked position between said casing and said carrier, and said contact bridge metal strip and said side contact metal strip being mounted within said carrier and said casing respectively so that only in the locked position of said carrier and said casing do said metal strips contact each other.

2. Fuse holder according to claim 1 wherein said positioning means is a one pin bayonet lock.

3. Fuse holder according to claim 1, wherein said anchoring means comprises a section of the contact bridge in the form of a metal strip being bent to form a slotted annular ring, said ring being resiliently clamped into said tubular carrier.

4. Fuse holder according to claim 1, wherein said anchoring means comprises a section of the contact bridge in the form of a metal strip being bent rectangularly away from the remaining metal strip, the bent-away-section having the shape of a circle, a square, a trapezoid or a triangle and being clamped into said tubular carrier.

5. Fuse holder according to claim 4, wherein said bent-away-section of the contact bridge metal strip has at least one point, clamp or tooth for penetration into the carrier material.

6. Fuse holder according to claim 1, wherein the contact bridge in the form of a metal strip has a bow-like section for improving contacting a lateral side of the second metal cap of the fuse link.

7. Fuse holder according to claim 6, wherein said bow-like section of the contact bridge metal strip has a step for a snap-fit with the lower rim of the second metal cap of the fuse link.

8. Fuse holder according to claim 1, wherein said carrier has a slot close to said open bottom and wherein said contact tongue is led out of the carrier through this slot.

9. Fuse holder according to claim 8, wherein said contact tongue is bent outwardly for improving the contact with said side contact metal strip in said casing.

10. Fuse holder according to claim 1, wherein said anchoring means comprises a longitudinal slot in the internal face of said tubular carrier, the width of the slot being adapted to accommodate the contact bridge in the form of a metal strip.

11. Fuse holder according to claim 10, wherein a lower section of said contact bridge metal strip is bent rectangularly to the remaining metal strip, the bent-away-section being placed between the spring and the closed top of said carrier.

* * * * *